US007338225B1

(12) United States Patent
Taylor

(10) Patent No.: US 7,338,225 B1
(45) Date of Patent: Mar. 4, 2008

(54) TOUCH UP PAINT APPLICATOR

(76) Inventor: Jerri L. Taylor, 128 Lake Lure Cir., Alma, GA (US) 31510-1571

( * ) Notice: Subject to any disclaimer, the term of this patent is extended or adjusted under 35 U.S.C. 154(b) by 0 days.

(21) Appl. No.: 11/545,606

(22) Filed: Oct. 9, 2006

(51) Int. Cl.
*A47L 13/26* (2006.01)
*B43K 5/06* (2006.01)
*B43K 8/12* (2006.01)
*B43K 5/00* (2006.01)

(52) U.S. Cl. ..... 401/13; 401/176; 401/205; 401/207

(58) Field of Classification Search ..... 401/176, 401/179, 182, 205, 206, 207, 13
See application file for complete search history.

(56) References Cited

U.S. PATENT DOCUMENTS 2,138,696 A * 11/1938 Francis ..... 425/87
2,961,680 A * 11/1960 Eggers ..... 401/182
3,738,760 A 6/1973 Madeira
4,269,330 A 5/1981 Johnson
5,077,086 A 12/1991 Cavill
5,577,851 A * 11/1996 Koptis ..... 401/202
5,633,048 A 5/1997 Bodin
5,783,254 A 7/1998 Maynard
5,938,360 A 8/1999 Yen et al.
6,065,477 A 5/2000 Doo
6,254,299 B1 7/2001 Russo
6,283,633 B1 9/2001 Gillespie et al.
D512,648 S 12/2005 Smith et al.
7,182,538 B2 * 2/2007 Grosso et al. ..... 401/176

* cited by examiner

*Primary Examiner*—David J. Walczak

(57) ABSTRACT

A refillable pen has a sponge tip and dispenses paint through the tip onto a substrate to repair a blemished paint surface when the sponge tip is pressed against the substrate.

3 Claims, 1 Drawing Sheet

TOUCH UP PAINT APPLICATOR

TECHNICAL FIELD OF THE INVENTION

The present invention relates to the general art of applicators, and to the particular field of paint applicators.

BACKGROUND OF THE INVENTION

It is well known to provide touch-up paints for use in covering scratches and other blemishes in walls, road vehicles, household appliances, furniture and other such products having a quality finish. These touch-up products have usually taken the form of a relatively small bottle having a cap from which is suspended an applicator brush. Other prior art containers have taken the form of aerosol cans from which touch-up paint is dispensed.

With greater emphasis placed on quality in automotive, appliance, etc., finishes it is often times desirable to use a rubbing compound after a touch-up paint has been applied for the purpose of removing slight blemishes in the paint surface. Rubbing compounds are commercially available although they are relatively inconvenient to use when packaged in rather large containers. The touch-up paint job is usually relatively small. Consequently a user will not normally take the time or trouble to purchase a separate container of rubbing compound in order to improve the quality of the touch-up finish.

A problem often met with in applying the paint is the difficulty of applying the paint to the scratched or chipped portion without also overpainting the surrounding unmarred finish with excess paint. Generally, the overpainted portion no longer matches the remainder of the surface and thus continues to lack an unblemished appearance which is desirable for a complete repair of the original finish. Although, individuals may have attempted to wipe away the excess new paint with a dry cloth, the problem has always been to remove the excess paint without, on the one hand, marring the original finish in those areas immediately adjacent the scratch or chip and, on the other hand, removing all of the paint applied to the chipped or scratched portion. Up to the present time there has been a notable lack of success in achieving a truly effective touch-up method which can be easily used by the general public.

Repair specialists have long experimented with methods of touching up marred, scratched and nicked paint on walls, surfaces, automobiles and other vehicles that have been damaged by collisions, vandals or the like. However damaged, dings, nicks and scratches in the paint are not only unsightly and value reducing, but also are accelerators of rust on substrates. Dust, dirt, salt, moisture, rain and other elements pierce the blemished paint and corrode or damage the substrate. This further reduces the value of the substrate as well as reducing the structural integrity of the item being protected by the paint.

To the cost conscious consumer, a small nick or ding or blemish is hardly worth the time and money to employ a professional to restore or fix the nick or blemish. In an attempt to overcome the need for expensive paint sprayers and the like, do-it-yourselfers have turned to more mundane means to effectively touch up slightly marred paint.

One such approach has been to use a conventional disposable hypodermic syringe. The worker fills the reservoir in the syringe with a desired paint solution and then attempts to apply the paint to the blemish through the needle. Conventional needles have a sharp, slanted distal end, designed to pierce skin so that medicine or the like may be delivered subcutaneously. Such sharp needles are poorly suited for the application of paint. The sharp distal end may inadvertently gouge, pit or scratch the paint that the user is trying to repair, and in some cases exacerbating the problem, especially if the paint is fairly thin. For example, conventional paint finishes on auto bodies are on the order of 5 mm thick, if a blemish is 2 mm deep, then there is no margin for error while inserting the needle into the blemish. The conventional needle may be much too narrow for the scratch or blemish at hand and repeated passes are required to completely coat the blemish with fresh paint.

It is also known to apply a coat of transparent paint or sealant composition to the touch-up paint to insure proper sealing. Once all of these steps have been completed, the surface of the touch up paint may be uneven proximate the repaired blemish and a standard solvent is frequently used on a cloth to wipe away excess paint or sealant from around the area of the repair.

Thus, with the problems associated with the conventional methods of repairing paint, there is a need to provide an economical, easy method and apparatus to touch up paint on walls, vehicles or other substrates.

SUMMARY OF THE INVENTION

The above-discussed disadvantages of the prior art are overcome by a refillable pen having a sponge tip through which touch up paint is dispensed onto a workpiece when the sponge tip is pressed against the workpiece to repair a blemished paint surface.

Using the device embodying the present invention will permit a user to accurately and precisely apply touch up paint to an area without overpainting or without further damaging the substrate.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
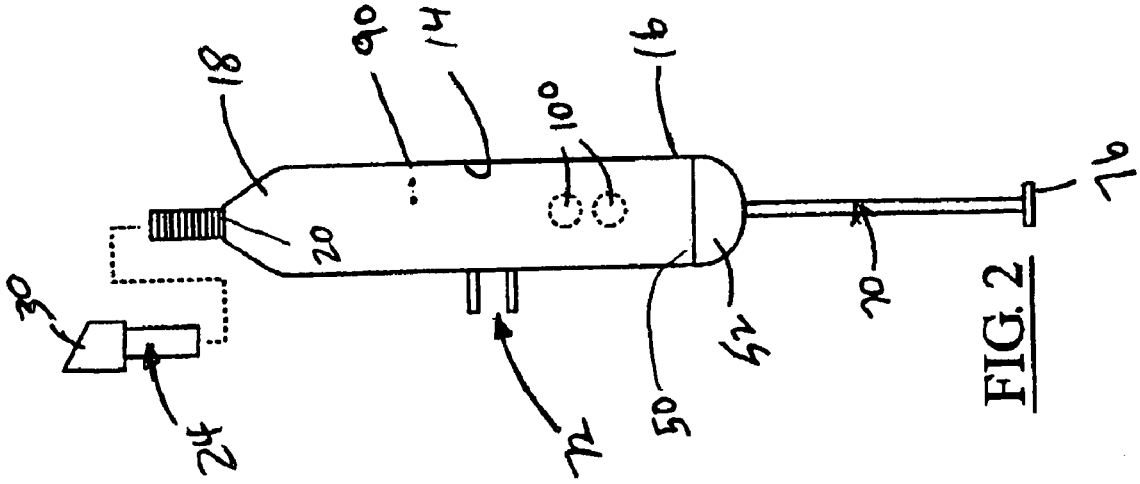
FIG. 2 is an elevational view of a paint applicator embodying the present invention in a use configuration.

Referring to the figures, it can be understood that the present invention is embodied in a touch up paint applicator 10. Applicator 10 comprises a cylindrical container 12 which has an interior volume 14, a first end 16 which is an aft end when the container is in use and a second end 18 which is a forward end when the container is in use.

A dispensing port 20 is defined in the forward end and is in fluid communication with the interior volume of the container. A dispensing nozzle 24 is mounted on the dispensing port and is in fluid communication with the interior volume of the container. A sponge tip 30 is mounted on the dispensing nozzle and is in the shape of an oblique truncated solid, such as a cylinder or a polygonal solid. If the sidewall is cylindrical, tip 30 has an overall shape of an ungula. Tip 30 includes a first wall 32 that is a bottom wall when the tip is in the use condition such as shown in the figures, a second wall 34 which is a sidewall and can be cylindrical or polygonal and a third wall 36 which is a top wall when the tip is in the use condition. The top wall is oriented at an oblique angle θ to the sidewall so an apex 38 is defined at the intersection of the top wall and the sidewall. The apex permits the tip to be used in a manner which precisely applies touch up paint to a specific location.

Figure 1:
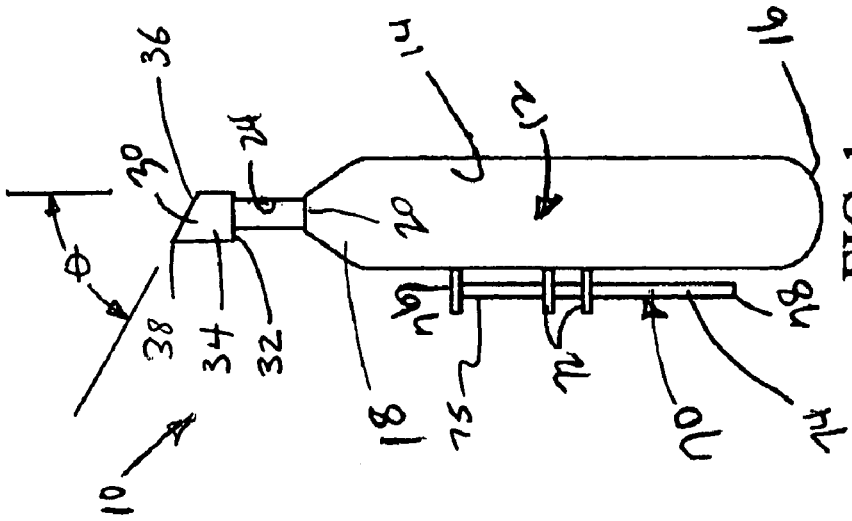
FIG. 1 is an elevational view of a paint applicator embodying the present invention in a stored configuration.

An entrance port 50 is located on the aft end of the container and a rubber sealer 52 is located on the container adjacent to the entrance port. A plunger handle mounting bracket unit 72 is located on the container, and a plunger 70 is releasably attached to the container by the bracket unit. Plunger 70 has a handle 74 which has a distal end 75 and proximal end 78. A plunger head 76 is provided on the distal end 75 of the handle 74. The handle of the plunger is movable between a stored condition shown in FIG. 1 in which the handle of the plunger is mounted in the mounting bracket unit and a use condition in which the handle of the plunger extends through the entrance port on the aft end of the container.

Touch up paint 90 is stored in the container. The touch up paint is forced out of the dispensing nozzle and through the sponge tip when the sponge tip is pressed against a workpiece being touched up and is drawn into the interior volume when the plunger is moved away from the forward end. The touch up paint applicator further includes mixing balls 100 located in the interior volume of the container.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A touch up paint applicator comprising:

A) a cylindrical container having an interior volume, a first end which is an aft end when the container is in use and a second end which is a forward end when the container is in use;

B) a dispensing port defined in the forward end, the dispensing port being in fluid communication with the interior volume of the container;

C) a dispensing nozzle on the dispensing port, the dispensing nozzle being in fluid communication with the interior volume of the container;

D) a sponge tip on the dispensing nozzle, the sponge tip including (1) a first wall that is a bottom wall when the sponge tip is in the use condition, (2) a second wall which is a sidewall, and (3) a third wall which is a top wall when the sponge tip is in the use condition, (4) the top wall of the sponge tip being oriented at an oblique angle to the sidewall of the sponge tip, (5) an apex being defined at the intersection of the top wall and the sidewall;

E) a rubber seal located adjacent to an entrance port on the aft end of the container;

F) a plunger handle mounting bracket unit on the container;

G) a plunger having (1) a handle having a distal end and proximal end, the handle of the plunger being movable between a stored condition in which the handle of the plunger is mounted in the mounting bracket unit and a use condition in which the handle of the plunger extends through the entrance port on the aft end of the container, and (2) a plunger head on the distal end of the handle of the plunger; and H) touch up paint stored in the container, the touch up paint being forced out of the dispensing nozzle and through the sponge tip when the sponge tip is pressed against a workpiece being touched up, and drawn into the interior volume when the plunger handle is moved away from the forward end.

2. The touch up paint applicator defined in claim 1 wherein the sponge tip is in the shape of an ungula.

3. A touch up paint applicator comprising:

A) a container having an interior volume, a first end which is an aft end when the container is in use, a second end which is a forward end when the container is in use, and a rubber seal located adjacent to the aft end of the container;

B) a dispensing nozzle on the forward end of the container, the dispensing nozzle being in fluid communication with the interior volume of the container;

C) a sponge tip on the dispensing nozzle, the sponge tip being in the shape of an oblique truncated solid and having an apex;

D) a plunger handle mounting bracket on the container;

E) a plunger having (1) a handle which is movable between a stored condition in which the handle of the plunger is mounted in the mounting bracket and a use condition in which the handle of the plunger extends into the container, and (2) a plunger head on the distal end of the handle of the plunger; and F) touch up paint stored in the container, the touch up paint being forced out of the dispensing nozzle and through the sponge tip when the sponge tip is pressed against a workpiece being touched up, and drawn into the interior volume when the plunger handle is moved away from the forward end.

* * * * *